US008231032B2

(12) United States Patent
Puma

(10) Patent No.: US 8,231,032 B2
(45) Date of Patent: Jul. 31, 2012

(54) DISPENSER FOR PRESSURIZED BEVERAGE BOTTLE

(76) Inventor: Samuel C. Puma, Winchester, CA (US)

( * ) Notice: Subject to any disclaimer, the term of this patent is extended or adjusted under 35 U.S.C. 154(b) by 513 days.

(21) Appl. No.: 12/497,423

(22) Filed: Jul. 2, 2009

(65) Prior Publication Data

US 2010/0001018 A1 Jan. 7, 2010

Related U.S. Application Data

(60) Provisional application No. 61/078,366, filed on Jul. 4, 2008.

(51) Int. Cl.
*B67D 3/00* (2006.01)

(52) U.S. Cl. ..... 222/520; 222/503; 222/549; 222/552; 222/568; 222/570; 215/44; 215/341

(58) Field of Classification Search ..... 222/519, 222/520, 547–549, 551, 552
See application file for complete search history.

(56) References Cited

U.S. PATENT DOCUMENTS

| | | | | |
|---|---|---|---|---|
| 5,897,037 | A * | 4/1999 | Mann | 222/519 |
| 6,446,844 | B1 | 9/2002 | Gross | |
| 6,997,359 | B2 * | 2/2006 | Boggs et al. | 222/520 |
| 7,232,046 | B1 | 6/2007 | Stassi | |

* cited by examiner

*Primary Examiner* — J. Casimer Jacyna
(74) *Attorney, Agent, or Firm* — Kenneth L. Green

(57) ABSTRACT

A beverage release cap over a bottle cap of a plastic carbonated beverage bottle for dispensing a beverage, without losing gasses inside the bottle, when the bottle is inverted or partially inverted for pouring. The beverage release cap has three distinct functional and physical sections. A lower section engaging a bottle rim below the bottle cap and snapping over the bottle rim, thereby retaining the beverage release cap to the bottle while providing a seal and permitting a twisting rotation of the beverage release cap. A middle section gripping the bottle cap with vertical, equally spaced ribs, a space between the ribs allowing beverage to flow between the bottle cap and the beverage release cap. An upper section providing a path for the beverage to flow from the middle section. The beverage release cap may alternatively be a replacement to the standard bottle cap.

10 Claims, 4 Drawing Sheets

DISPENSER FOR PRESSURIZED BEVERAGE BOTTLE

The present application claims the priority of U.S. Provisional Patent Application Ser. No. 61/078,366 filed Jul. 4, 2008, which application is incorporated in its entirety herein by reference.

BACKGROUND OF THE INVENTION

The present invention relates to sealing pressurized bottles and in particular to retaining carbonation in carbonated beverage bottles after opening.

Carbonated beverages are enjoyed with meals, as a refreshment between meals, at sporting events, and at parties. Carbonated beverages are available in single small cans, for example, 12 ounce cans, 16 and 20 ounce bottles, and larger economy sized bottles. The large economy sized bottles are generally sold for a lower per ounce price than small container sizes.

The large economy sized bottles have a plastic rigid screw cap which seals to a screw-threaded neck. When the cap is unscrewed to pour the beverage, the pressurized carbon dioxide gas on top of the liquid is released into the atmosphere. The gas will continue to bubble off and escape as long as the cap is not sealing the bottle. When the cap is screwed back onto the neck of the bottle, and forms a seal, the gas will continue to bubble until equilibrium is established between the dissolved gas and the evolved gas over the liquid inside the bottle. As this process is repeated, the dissolved gas will gradually become depleted rendering the beverage "flat". Beverage companies attempt to counter this tendency by putting excess carbonation in the bottles. In addition, some beverages seem to hold their carbonation better than others. Unfortunately, neither excess carbonization nor beverage selection has succeeded in substantially delaying the beverage going flat before consumption.

Many elaborate mechanisms have been proposed to overcome this problem. Such apparatus is described in U.S. Pat. No. 7,232,046 for "Pressurized Dispenser for Beverage Bottle". The apparatus of the '046 patent helps retain carbonation, but is overly complex and expensive. The '046 patent further includes a good review of the prior art, and is incorporated herein its entirety by reference.

BRIEF SUMMARY OF THE INVENTION

The present invention addresses the above and other needs by providing a beverage release cap residing over a bottle cap of a plastic carbonated beverage bottle for selectively dispensing a beverage, without losing gases inside the bottle. The beverage release cap allows the carbonated beverage to be dispensed without the release of evolved gas within the bottle when the bottle is inverted or partially inverted for pouring. The beverage release cap has three distinct functional and physical sections. A lower section engaging a bottle rim below the bottle cap and snapping over the bottle rim, thereby retaining the beverage release cap to the bottle while providing a seal and permitting a twisting rotation of the beverage release cap. A middle section gripping the bottle cap with vertical, equally spaced ribs, a space between the ribs allowing beverage to flow between the bottle cap and the beverage release cap. An upper section providing a pouring spout and a path for the beverage to flow from the middle section to the spout. Functionally, the beverage release cap is secured over the bottle cap of the beverage bottle containing a gas charged liquid. The bottle is then inverted sufficiently to keep the neck of the bottle filled with the beverage. The beverage release cap is twisted while engaging the bottle cap, which loosens the bottle cap. The loosening breaks a pressure seal and allows dispensing of the beverage into a suitable container without releasing the gases in the bottle. The beverage release cap is then twisted to close the bottle cap before returning the bottle to an upright position. The beverage release cap may alternatively be a replacement to the standard bottle cap.

In accordance with one aspect of the invention, there is provided a novel beverage release cap to preserve the "fizz" or carbonation in a beverage bottle when the beverage is being dispensed. The beverage release cap is constructed of a food grade flexible rubber or plastic material. The beverage release cap is pressed onto a cleaned unopened bottle cap so that it encloses the cap and engages an exposed upper bottle rim of the beverage bottle just below a bottom edge of the bottle cap. The bottle is then inverted or partially inverted so that liquid fills the neck of the bottle before liquid is dispensed. The beverage release cap is grasped at a mid point over the sides of the beverage release cap and slowly twisted to loosen the beverage release cap and the bottle cap enclosed by the beverage release cap. The beverage release cap is loosened only enough to allow a satisfactory beverage flow rate. Pressure, generated by the carbonation forces the beverage out of the bottle between the bottle neck and the loose bottle cap. The beverage then flows through the spaces between the bottle cap and vertical ridges on the interior of the beverage release cap and out through the spout. During the pouring process, carbon dioxide gas is retained within the bottle. When the desired amount of beverage is dispensed, the beverage release cap is twisted closed before returning the bottle to the upright position. The pouring process is repeated until the bottle is empty. Carbon dioxide gas will effervesce out of the remaining beverage to fill the void created as the beverage is dispensed, but such effervesce is limited because the void is quickly filled and gas pressure equilibrium is reached without the beverage losing a noticeable amount of carbonation. When the bottle is empty, the beverage release cap can be removed and cleaned awaiting further use.

In accordance with another aspect of the invention, there is provided a beverage release cap to replace a standard bottle cap on a carbonated beverage bottle. The beverage release cap attaches to the beverage bottle using threads common to known carbonated beverage bottles, but includes a sealing ring in the interior of the base of the beverage release cap to seal against the exterior of the bottle neck and a window near the top of the beverage release cap for releasing beverage when the beverage release cap is partially opened.

In accordance with another aspect of the invention, there is provided a method for retaining carbonation in an opened carbonated beverage bottle. The method includes retaining an original carbonated beverage bottle cap on a threaded mouth of the carbonated beverage bottle in an un-opened and undisturbed condition thereby retaining carbonation in the beverage bottle, installing a beverage release cap over the original carbonated beverage bottle cap, engaging inside ribs of the beverage release cap with an outside surface of the carbonated beverage bottle cap, positioning the carbonated beverage bottle with the caps down, twisting the beverage release cap in a first direction to loosen while not removing the carbonated beverage bottle cap from the carbonated beverage bottle and not removing the beverage release cap from the carbonated beverage bottle cap, releasing carbonated beverage from the carbonated beverage bottle through first passages between outside threads of the threaded mouth of the carbonated beverage bottle and inside threads of the carbonated beverage bottle cap and through second passages between an outside surface of the carbonated beverage bottle cap and the inside ribs of the beverage release cap, twisting the beverage release cap in a second direction opposite the first direction to tighten the carbonated beverage bottle cap on the carbonated beverage bottle to reseal the carbonated beverage bottle, and returning the carbonated beverage bottle to an upright position. The carbonated beverage bottle generally includes a bottle neck ring below the battle cap and installing a beverage release cap generally comprises snapping the beverage release cap onto a bottle neck ring below the bottle cap. Further, the beverage release cap may be twisted an amount to achieve a desired flow rate from the carbonated beverage bottle.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
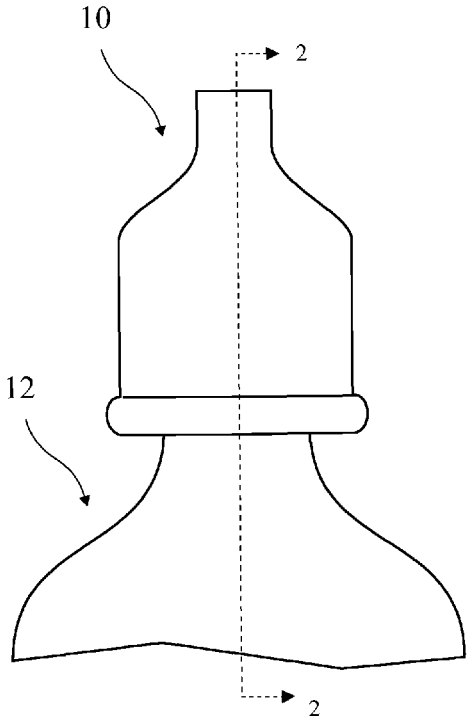
FIG. 1 is a side view of a beverage release cap according to the present invention on a carbonated beverage bottle
Figure 2:
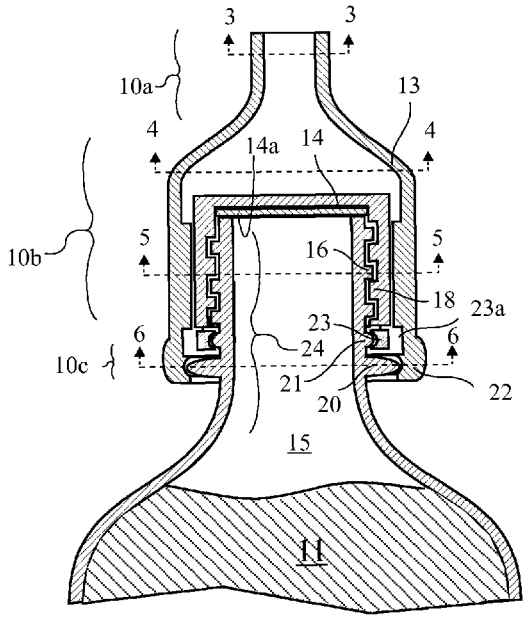
FIG. 2 is a vertical cross-sectional view of the beverage release cap according to the present invention on the carbonated beverage bottle taken along line 2-2 of FIG. 1.
Figure 3:
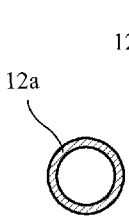
FIG. 3 is a horizontal cross-sectional view of the beverage release cap according to the present invention taken along line 3-3 of FIG. 2.
Figure 4:
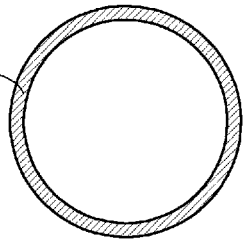
FIG. 4 is a horizontal cross-sectional view of the beverage release cap according to the present invention taken along line 4-4 of FIG. 2.
Figure 5:
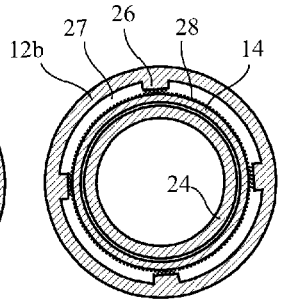
FIG. 5 is a horizontal cross-sectional view of the beverage release cap according to the present invention, a bottle cap, and a bottle neck taken along line 5-5 of FIG. 2.
Figure 6:
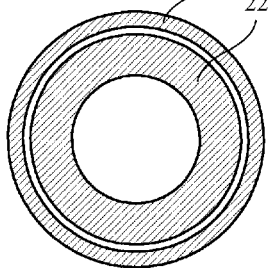
FIG. 6 is a horizontal cross-sectional view of the beverage release cap according to the present invention and a bottle neck ring taken along line 6-6 of FIG. 2.

A side view of a beverage release cap 10 according to the present invention on a carbonated beverage bottle 12 is shown in FIG. 1 and a vertical cross-sectional view of the beverage release cap 10 on the carbonated beverage bottle 12 taken along line 2-2 of FIG. 1 is shown in FIG. 2. Additionally, a horizontal cross-sectional view of the beverage release cap 10 taken along line 3-3 of FIG. 2 is shown in FIG. 3, a horizontal cross-sectional view of the beverage release cap 10 taken along line 4-4 of FIG. 2 is shown in FIG. 4, a horizontal cross-sectional view of the beverage release cap 10, a bottle cap 14, and a bottle neck 24 taken along line 5-5 of FIG. 2 is shown in FIG. 5, and a horizontal cross-sectional view of the beverage release cap 10 and a bottle neck ring 20 taken along line 6-6 of FIG. 2 is shown in FIG. 6. Carbonated beverage 11 resides inside the carbonated beverage bottle 12 with gasses 15 also residing in the carbonated beverage bottle 12 above the beverage 11. The beverage release cap 10 narrows from a shoulder 13 to a top portion (or spout) 10*a* providing a manageable release of the carbonated beverage 11 from the carbonated beverage bottle 12. The beverage release cap 10 includes a retaining groove 22 engaging (or snapping onto) the bottle neck ring 20 to retain the beverage release cap 10 on the carbonated beverage bottle 12 and provide a seal between the beverage release cap 10 and the bottle neck 24. The seal between the beverage release cap 10 and the bottle neck 24 does not need to be too tight because the beverage is free to flow out of the beverage release cap 10 as soon as the bottle cap 14 is loosened, so very little pressure exists inside the beverage release cap 10. A bottle seal 14*a* resides against a top inside surface of the bottle cap 14 for sealing the carbonated beverage bottle 12 when the bottle cap 14 is tightened on the bottle neck 24, and a tamper seal 23 resides over a tamper seal ring 21 in an internal tamper seal groove 23*a* near the base of the beverage release cap 10. The tamper seal 23 is originally minimally attached to the bottle cap 14 and breaks away when the bottle cap 14 is first opened.

The bottle neck 24 has male threads 16 and the bottle cap 14 has cooperating female threads 18 for screwing the bottle cap 14 onto the beverage bottle 12. The beverage release cap 10 further includes interior ribs 26 for engaging the exterior 28 of the bottle cap 14 to turn the bottle cap 14 with the beverage release cap 10 in place over the bottle cap 14. The ribs 26 are preferably grooved ribs and the exterior 28 is preferably similarly grooved as in known bottle caps to couple turning the beverage release cap 10 to the bottle cap 14. The ribs 26 are more preferably four ribs 26 spaced angularly apart.

The beverage release cap 10 may further be described as having three vertically spaced apart sections. A lower section 10*c* engaging the bottle rim 20 below the bottle cap 14 and snaps over the bottle rim 20, thereby retaining the beverage release cap 10 on the beverage bottle 12 while providing a seal and permitting a twisting rotation of the beverage release cap 10. A middle section 10*b* gripping the bottle cap 14 with vertical, equally angularly spaced apart ribs 26, spaces 27 between the ribs 26, the spaces 27 are wider than the ribs 26, allowing beverage to flow between the bottle cap 14 and the beverage release cap 10. An upper section 10*a* providing a spout for pouring the beverage and a path for the beverage 11 to flow from the middle section 10*b* to the spout.

Figure 7A:
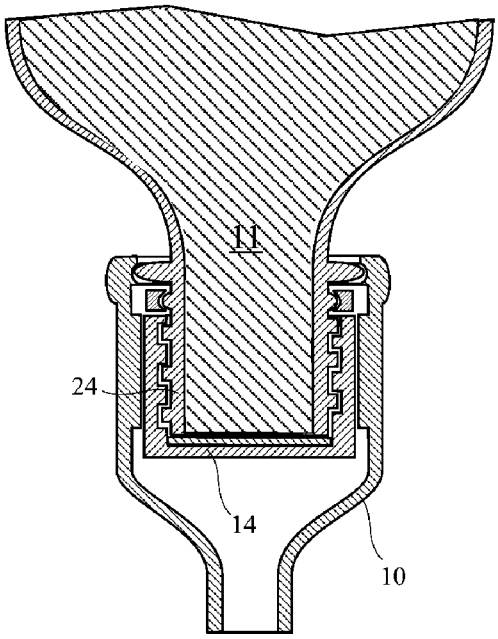
FIG. 7A shows the carbonated beverage bottle inverted with the beverage release cap in a closed position to prevent the release of beverages and gasses.
Figure 7B:
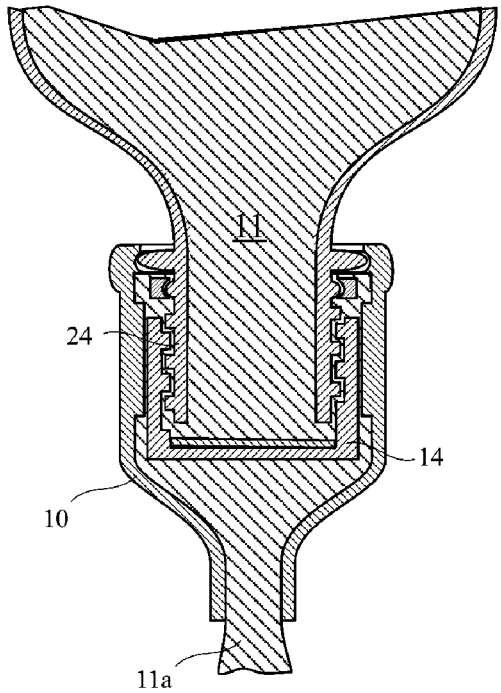
FIG. 7B shows the carbonated beverage bottle inverted with the beverage release cap in an open position to allow the release of beverages while preventing the escape of gasses.

The carbonated beverage bottle 12 is shown inverted with the beverage release cap 10 tightened on the beverage bottle 12 in a closed position to prevent escape of the beverages 11 and gasses in FIG. 7A and the carbonated beverage bottle is shown inverted with the beverage release cap 10 loosened on the beverage bottle 12 in an open position to allow the release of the beverages 11 in FIG. 7B. The gasses 15 do not escape when the beverage 11 is poured because the gases 15 are now at the opposite end of the carbonated beverage bottle 12. The bottle cap 14 is loosely threaded on the bottle neck 24. When the bottle cap 14 is loosened, sufficient space exists between the outside of the bottle neck 24 and the inside of the bottle cap 14 to allow the beverage 11 to flow there between. Similarly, sufficient space exists between the bottle cap 24 and the beverage release cap 10 to allow the beverage to flow there between, thus releasing a flow of the beverage 11*a* from the carbonated beverage bottle 12. Pressure, generated by the carbonation, in combination with gravity, pushes the beverage 11 out of the beverage bottle 12. As long as the beverage release cap 10 remains tight while the beverage bottle 12 is upright, and is only loosened while the bottle neck 24 is filled with the beverage 11, none of the gasses 15 will escape and the beverage will retain its carbonation.

Figure 8:
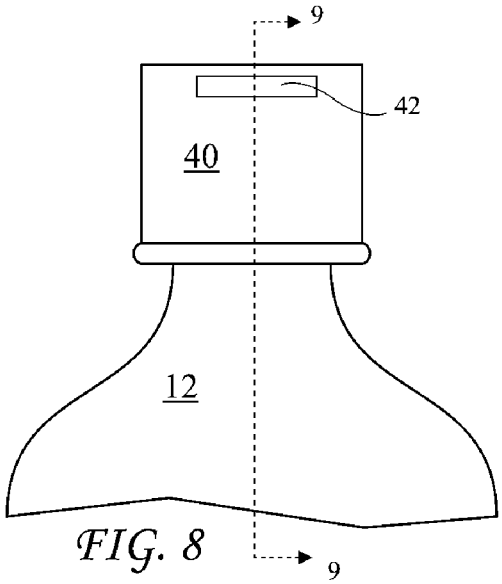
FIG. 8 is a side view of a second beverage release cap according to the present invention on the carbonated beverage bottle
Figure 9:
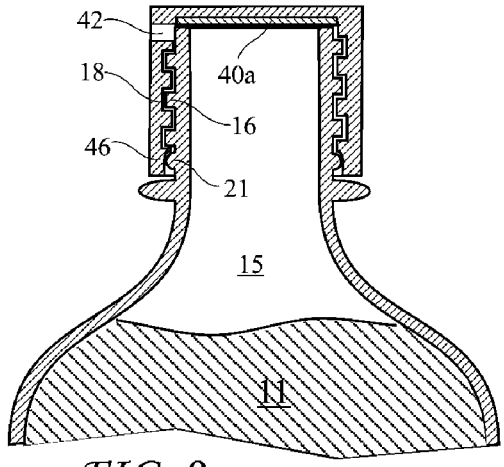
FIG. 9 is a vertical cross-sectional view of the second beverage release cap according to the present invention on the carbonated beverage bottle taken along line 9-9 of FIG. 8.

A side view of a second beverage release cap 40 according to the present invention on the carbonated beverage bottle 12 is shown in FIG. 8 and a vertical cross-sectional view of the second beverage release cap 40 on the carbonated beverage bottle 12 taken along line 9-9 of FIG. 8 is shown in FIG. 9. The second beverage release cap 40 replaces the bottle cap 14 (see FIG. 2) found on known beverage bottles. The second beverage release cap 40 includes the female threads 18 found in known bottle caps 14, but also includes a seal 46 for sealing against the tamper seal ring 21, and a window 42 for pouring the beverage 11 from the beverage bottle 12. The second beverage release cap 40 may be tightly screwed onto the beverage bottle 12 and provide the same sealing as the bottle cap 14. But, the second beverage release cap 40 may be loosened to allow the beverage to escape the beverage bottle 12 through the window 42. As long as the second beverage release cap 40 remains tight while the beverage bottle 12 is upright, and is only loosened while the bottle neck 24 is filled with the beverage 11, none of the gasses 15 will escape and the beverage 11 will retain its carbonation.

Figure 10A:
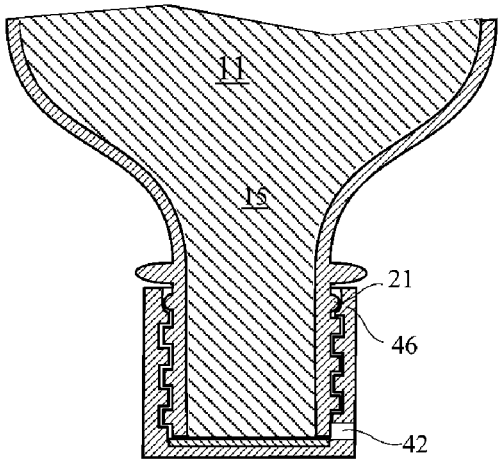
FIG. 10A shows the carbonated beverage bottle inverted with the second beverage release cap in a closed position to prevent the release of beverages and gasses.
Figure 10B:
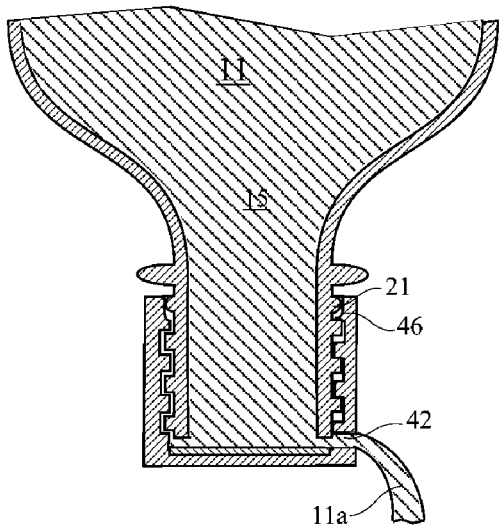
FIG. 10B shows the carbonated beverage bottle inverted with the second beverage release cap in an open position to allow the release of beverages while preventing the escape of gasses.

The carbonated beverage bottle 12 is shown inverted in FIG. 10A with the second beverage release cap 40 tight on the beverage bottle 12 in a closed position to prevent release of the beverage 11 and the gasses 15, and the carbonated beverage bottle 12 is shown inverted in FIG. 10B with the second beverage release cap 40 loosened on the beverage bottle 12 in an open position to allow the release of the beverage 11 while preventing the escape of the gasses 15. The seal 46 remains in contact against the tamper seal ring 21 when the second beverage release cap 40 is loosened preventing the beverage 11 from leaking between the bottle neck 24 and the second beverage release cap 40. As long as the second beverage release cap 40 remains tight while the beverage bottle 12 is upright, and is only loosened while the bottle neck 24 is filled with the beverage 11, none of the gasses 15 will escape and the beverage will retain its carbonation.

Figure 12:
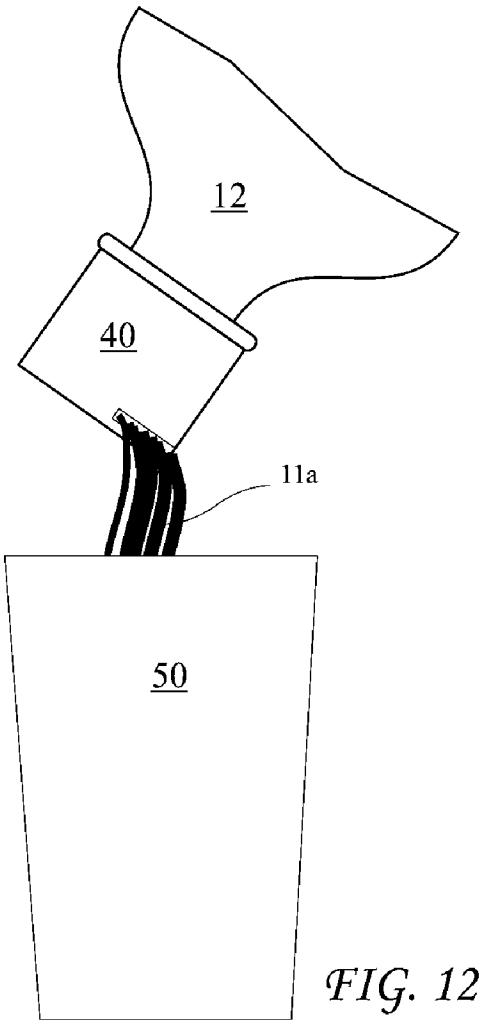
FIG. 12 shows the carbonated beverage bottle and the second beverage release cap inverted and open for releasing beverage from the carbonated beverage bottle.
Figure 11:
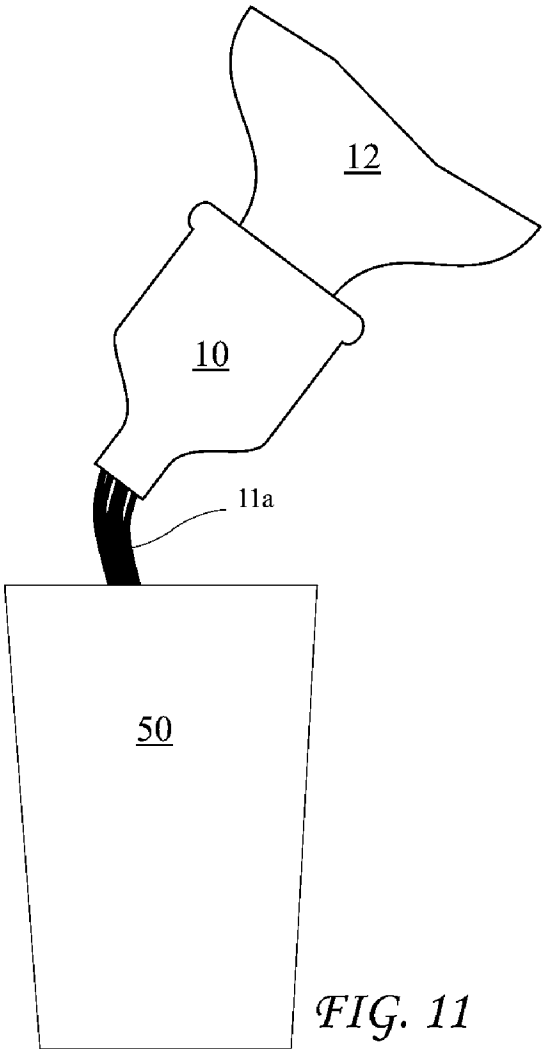
FIG. 11 shows the carbonated beverage bottle and the beverage release cap inverted and open for releasing beverage from the carbonated beverage bottle.

The carbonated beverage bottle 12 and the beverage release cap 10 are shown inverted and open for releasing the beverage 11 from the carbonated beverage bottle 12 into a glass 50 in FIG. 11 and the carbonated beverage bottle 12 and the second beverage release cap 40 are shown inverted and open for releasing beverage from the carbonated beverage bottle 12 into the glass 50 in FIG. 12. In each instance, the beverage 11 has flowed into the bottle neck 24 and the gasses 15 have flowed to the opposite end of the beverage bottle 12. The beverage bottle 12 does not need to be inverted 180 degrees, and is sufficiently inverted as long as the beverage 11 completely fills the bottle neck 24 (see FIG. 2.)

While the invention herein disclosed has been described by means of specific embodiments and applications thereof, numerous modifications and variations could be made thereto by those skilled in the art without departing from the scope of the invention set forth in the claims.

I claim:

1. A gas retaining container comprising:

carbonated beverage bottle;

a carbonated beverage residing in the carbonated beverage bottle;

a bottle neck at an upper end of the carbonated beverage bottle, the bottle neck including male threads;

a bottle neck rim below the male threads;

a bottle cap having female threads on an interior surface engaging the male threads of the bottle neck for securing and sealing the bottle cap to the bottle neck;

a tamper seal residing over a tamper seal ring between the bottle neck rim and the male threads, the tamper seal detachable from the bottle cap upon releasing the bottle cap from the carbonated beverage bottle to indicate that the carbonated beverage bottle has been opened; and a beverage release cap residing over the bottle cap and including:

an open top;

a retaining groove on a lower inside surface of the beverage release cap cooperating with the bottle neck rim for retaining the beverage release cap on the bottle neck and providing a seal between the beverage release cap and the carbonated beverage bottle both when the beverage release cap is closed and when the beverage release cap is opened to release the carbonated beverage;

an internal tamper seal groove near the base of the beverage release cap containing the tamper seal residing over the tamper seal ring; and an inside surface of the beverage release cap including angularly spaced apart axially extending ribs reaching in to contact the bottle cap, inner surfaces of the ribs engaging an outside surface of the bottle cap to couple turning of the beverage release cap to turning of the bottle cap, spaces between the ribs allowing the carbonated beverage to escape from the carbonated beverage bottle, wherein turning the beverage release cap to turn the bottle cap releases beverage to flow between the bottle neck and the bottle cap and between the bottle cap and the beverage release cap and out the open top of the beverage release cap, the beverage release cap remaining translationally fixed on the carbonated beverage bottle during rotation to release the carbonated beverage.

2. The gas retaining container of claim 1, wherein the inner surfaces of the ribs have axially extending grooves for engaging grooves the outside surface of the bottle cap coupling turning of the beverage release cap to turning of the bottle cap.

3. The gas retaining container of claim 2, wherein the ribs on the interior of the beverage release cap comprise four ribs.

4. A gas retaining container comprising:

carbonated beverage bottle;

a carbonated beverage residing in the carbonated beverage bottle;

a bottle neck at an upper end of the carbonated beverage bottle, the bottle neck including male threads;

a bottle neck rim below the male threads; and a beverage release cap residing over the bottle and threadably cooperating with the male threads of the bottle neck and including:

a lower end residing towards the carbonated beverage bottle;

a sealing portion of the release cap residing proximal to the lower end and sealingly cooperating with the bottle neck;

an internal tamper seal groove near the base of the beverage release cap providing space for a tamper seal residing over a tamper seal ring, the tamper seal detachable from the bottle cap upon releasing the bottle cap from the carbonated beverage bottle, and a passage opposite the lower end providing fluid cooperation between an interior of the beverage release cap and an exterior of the beverage release cap, wherein turning the beverage release cap releases beverage to flow out of the carbonated beverage bottle through the passage in the beverage release cap, the beverage release cap remaining translationally fixed on the carbonated beverage bottle during rotation to release the carbonated beverage.

5. The gas retaining container of claim 4, wherein the beverage release cap seals against a bottle neck ring of the neck.

6. The gas retaining container of claim 4, wherein the beverage release cap seals against a tamper seal ring of the neck.

7. The gas retaining container of claim 6, wherein the seal is in contact with the tamper seal ring when the bottle cap is tightened to secure the carbonated beverage and when the bottle cap is loosened to release the carbonated beverage.

8. The gas retaining container of claim 2, wherein the spaces are wider than the ribs.

9. The gas retaining container of claim 4, wherein an inside surface of the beverage release cap including angularly spaced apart axially extending ribs reaching in to contact the bottle cap, inner surfaces of the ribs engaging an outside surface of the bottle cap to couple turning of the beverage release cap to turning of the bottle cap, spaces between the ribs allowing the carbonated beverage to escape from the carbonated beverage bottle.

10. The gas retaining container of claim 9, wherein the spaces are wider than the ribs.

* * * * *